US007913398B2

(12) United States Patent
Chu

(10) Patent No.: US 7,913,398 B2
(45) Date of Patent: Mar. 29, 2011

(54) FOLDING KNIFE WITH AN UNLOCKING MECHANISM

(76) Inventor: Li-Pen Chu, Taipei Hsien (TW)

( * ) Notice: Subject to any disclaimer, the term of this patent is extended or adjusted under 35 U.S.C. 154(b) by 351 days.

(21) Appl. No.: 12/149,187

(22) Filed: Apr. 29, 2008

(65) Prior Publication Data

US 2009/0265939 A1 Oct. 29, 2009

(51) Int. Cl.
*B26B 1/04* (2006.01)

(52) U.S. Cl. ..... 30/161; 30/160

(58) Field of Classification Search ..... 30/151–161, 30/330, 331, 337–339; 7/118–120
See application file for complete search history.

(56) References Cited

U.S. PATENT DOCUMENTS

| | | | | | |
|---|---|---|---|---|---|
| 730,025 | A * | 6/1903 | Kaufmann | 30/161 |
| 4,040,181 | A * | 8/1977 | Johnson | 30/161 |
| 5,331,741 | A * | 7/1994 | Taylor, Jr. | 30/158 |
| 5,442,855 | A * | 8/1995 | Jobin | 30/161 |
| 5,826,340 | A * | 10/1998 | Hull | 30/161 |
| 6,523,265 | B2 * | 2/2003 | Eickhorn | 30/161 |
| 6,968,622 | B2 * | 11/2005 | Ping | 30/156 |
| 7,140,110 | B2 * | 11/2006 | Lake | 30/160 |
| 7,533,465 | B1 * | 5/2009 | Frazer | 30/155 |
| 7,600,322 | B2 * | 10/2009 | Kao | 30/151 |
| 7,647,701 | B1 * | 1/2010 | Mollick et al. | 30/155 |
| 7,676,932 | B2 * | 3/2010 | Grice et al. | 30/160 |
| 2006/0288585 | A1 * | 12/2006 | Kao | 30/159 |

* cited by examiner

*Primary Examiner* — Edward Landrum
(74) *Attorney, Agent, or Firm* — Bacon & Thomas, PLLC

(57) ABSTRACT

A folding knife has a handle, a blade, a locking rod and an unlocking lever. The handle has a dorsal portion. The blade is pivotally mounted and selectively folded in the handle and has a notch. The notch is formed on a spine of the blade. The locking rod is mounted on the dorsal portion of the handle and has a locking end and a protrusion. The protrusion is formed on the locking end and engages the notch of the blade. The unlocking lever is pivotally mounted on the handle and has a pushing end and at least one propping block. The propping block protrudes from the unlocking lever and abuts the locking rod. Therefore, the folding knife allows users to release the blade by either directly pressing the locking rod or pushing the pushing end of the unlocking lever.

7 Claims, 7 Drawing Sheets

FOLDING KNIFE WITH AN UNLOCKING MECHANISM

BACKGROUND OF THE INVENTION

1. Field of the Invention

The present invention relates to a folding knife with an unlocking mechanism, especially a folding knife that has an unlocking lever mounted on the handle that abuts a locking rod to help people unlock the blade and fold the folding knife.

2. Description of the Prior Arts

A folding knife comprises a blade being folded into the handle to safely store the blade; therefore, the folding knife is especially suitable for carrying on outdoor activities.

With reference to FIG. 7, a conventional folding knife has a handle (60), a blade (50), and a locking rod (61). The handle (60) has a dorsal portion (601), a chamber (62), and a concave portion (63). The chamber (62) is formed on the handle (60). The concave portion (63) is formed on the dorsal portion (601) of the handle (63) and opposite to the chamber (62). The blade (50) is pivotally connected to the handle (60), is selectively folded in the chamber (62) and has a notch (51). The notch (51) is formed on the blade (62). The locking rod (61) is mounted on the dorsal portion (601) of the handle (60) and has a middle, two ends and a protrusion (611). The middle is pivotally mounted in the handle (60). One of the two ends protrudes in the concave portion (63). The protrusion (611) is formed on the other end and engages the notch (51) of the blade (50) so as to hold the blade (50) unfolded.

To close the folding knife, the end of locking rod (61) protruding in the concave portion (63) is pressed, usually using a thumb since the thumb is stronger than other fingers. However, a user must change their grip of the handle (50) to press the locking rod (61) using their thumb to fold the blade (50) into the chamber (62). This is inconvenient and may cause the knife to be dropped accidentally while changing grip.

To overcome the shortcomings, the present invention provides a folding knife to mitigate or obviate the aforementioned problems.

SUMMARY OF THE INVENTION

The main objective of the invention is to provide a folding knife with an unlocking mechanism that is convenient to unlock a blade of the folding knife without changing grip on the knife.

A folding knife comprises a handle, a blade, a locking rod and an unlocking lever.

The handle has a front, a rear, a dorsal portion, a ventral portion, a first frame, a second frame, an arresting mechanism and a chamber. The dorsal portion extends from the front to the rear of the handle. The ventral portion is opposite to the dorsal portion. The first frame has an outer surface, a throughhole and an arch edge. The throughhole is formed through the first frame near the front of the handle. The arch edge is near the dorsal portion of the handle. The second frame is attached to the first frame and has an outer surface and an arch edge. The arch edge is formed on the second frame and corresponds to the arch edge of the first frame. The arresting mechanism is mounted between the first and second frames near the dorsal portion of the handle. The chamber is formed between the first frame, second frame and the arresting mechanism.

The blade is pivotally mounted between the first frame and the second frame, is selectively folded into the chamber and has a rear, a spine and a notch. The rear is pivotally mounted between the first frame and the second frame. The notch is formed on the spine of the blade near the rear of the blade.

The locking rod is mounted between the arresting mechanism and the rear of the blade and has a middle, a locking end, a releasing end, an inner edge and a protrusion. The middle is pivotally mounted between the first frame and the second frame. The locking end is mounted near the front of the handle. The releasing end is opposite to the locking end, is mounted between the arch edges of the first frame and the second frame of the handle and abuts the arresting mechanism. The inner edge faces the chamber of the handle. The protrusion is formed on the inner edge near the locking end and corresponds to and selectively engages the notch of the blade.

The unlocking lever is mounted on the outer surface of the first frame and has a rib. The rib has a pivoting end, a pushing end and at least one propping block. The pivoting end is pivotally mounted on the outer surface of the first frame such that the unlocking lever pivots about a pivot axis. The pushing end extends out from the pivoting end of the rib toward the ventral portion of the handle. The at least one propping block extends out from the pivoting end, passes through the throughhole and abuts the inner edge of the locking rod.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
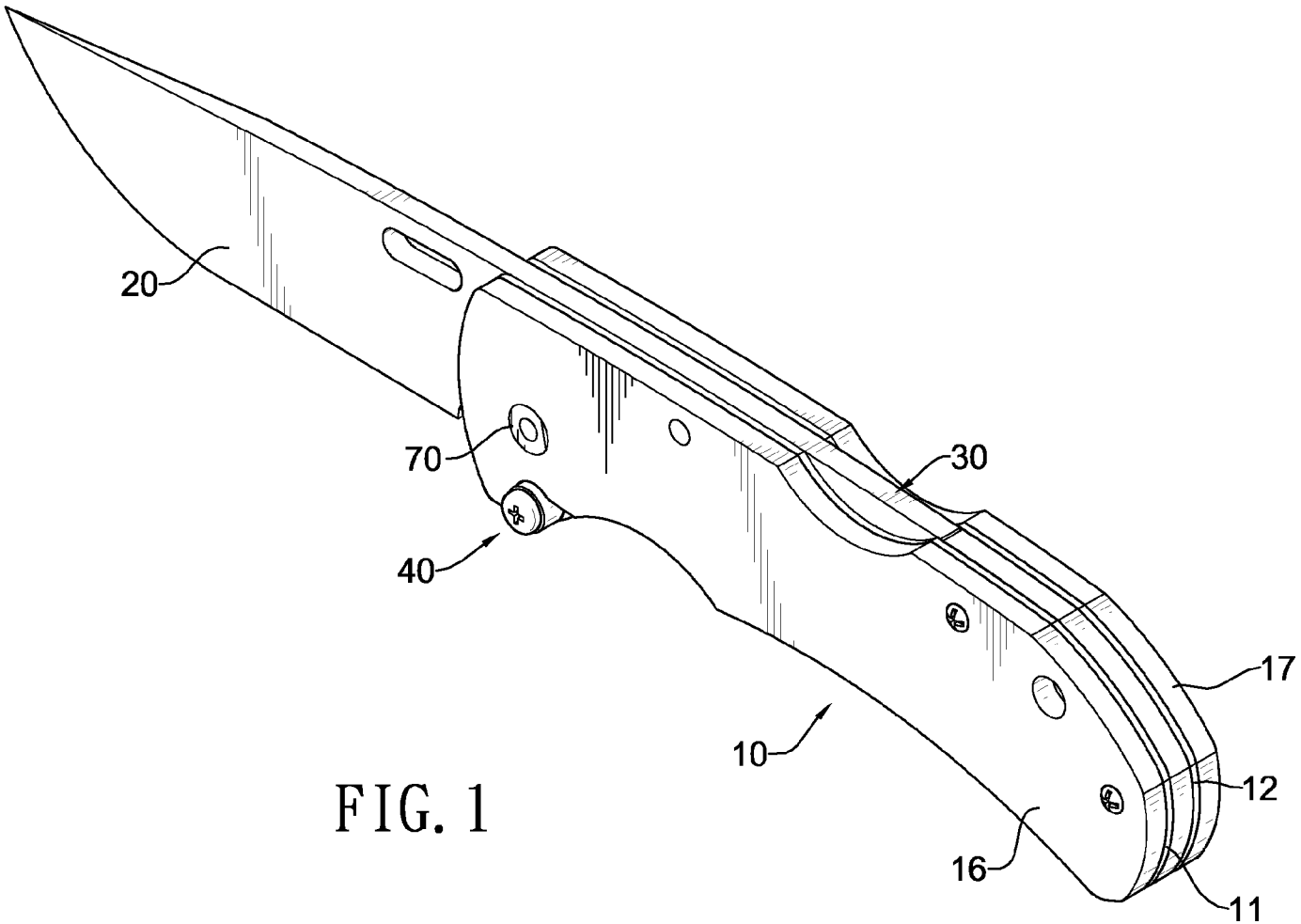
FIG. 1 is a perspective view of a first embodiment of a folding knife with an unlocking mechanism in accordance with the present invention.

With reference to FIG. 1, a folding knife with an unlocking mechanism in accordance with the present invention comprises a handle (10), a blade (20), a locking rod (30), an unlocking lever (40) and a pintle (70).

Figure 2:
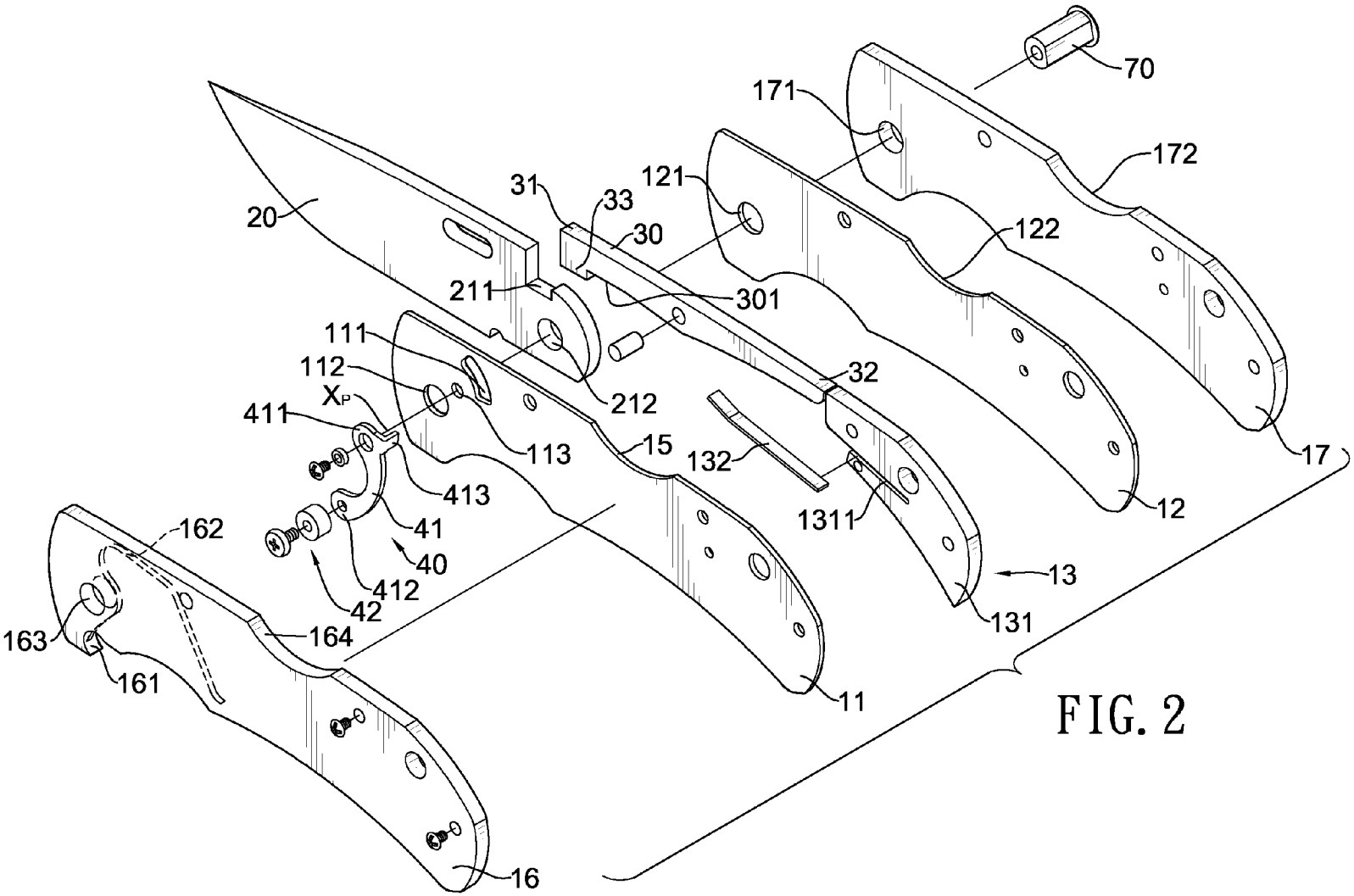
FIG. 2 is an exploded perspective view of the folding knife in FIG. 1.
Figure 3:
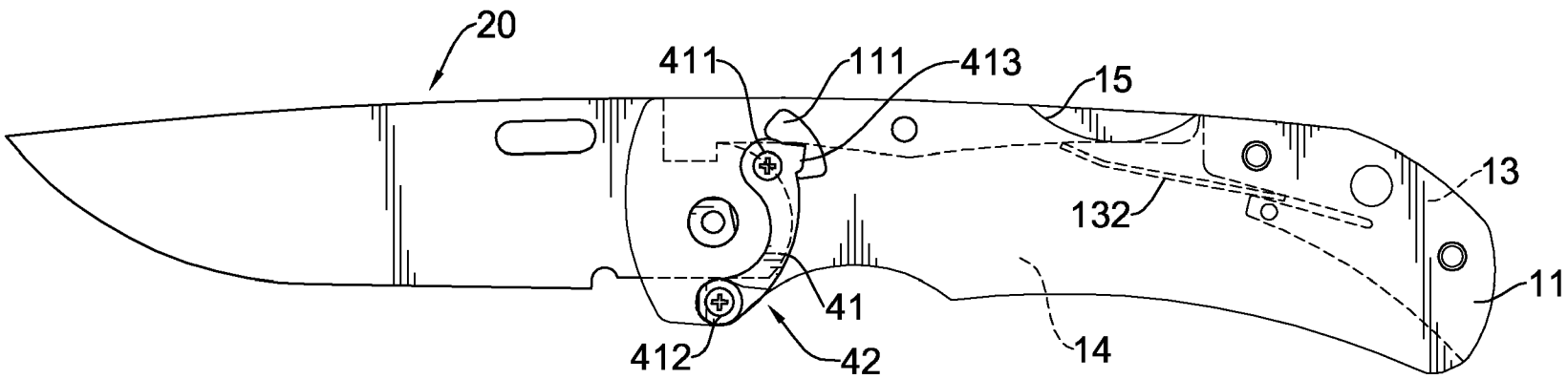
FIG. 3 is a side view of the folding knife in FIG. 1.

With further reference to FIGS. 2 and 3, the handle (10) has a front, a rear, a dorsal portion and a ventral portion, a first frame (11), a second frame (12), an arresting mechanism (13) and a chamber (14), and may have a first casing (16) and a second casing (17).

The dorsal portion extends from the front of the handle (10) to the rear of the handle (10).

The ventral portion is opposite to the dorsal portion.

The first frame (11) has an outer surface and, a throughhole (111), an arch edge (15) and selectively has a pivot hole (112) and an aperture (113). The throughhole (111) is formed through the first frame (11) near the front of the handle (10). The arch edge (15) is near the dorsal portion of the handle (10). The pivot hole (112) is formed through the first frame (11) near the throughhole (111). The aperture (113) is formed on the first frame (11) near the front of the handle (10) and between the throughhole (111) and the pivot hole (112) of the first frame (11).

The second frame (12) is attached to the first frame (12) and has an edge, an outer surface, an arch edge 122) and a pivot hole (121). The pivot hole (121) is formed through the second frame (12) and aligns with the pivot hole (112) of the first frame (11). The arch edge (122) is near the dorsal portion of the handle (10) and corresponds to the arch edge (15) of the first frame (11).

The arresting mechanism (13) is mounted between the first and second frames (11, 12) near the dorsal portion of the handle (10) and may have a base (131) and a stop arm (132). The base (131) is mounted between the first frame (11) and the second frame (12) near the rear of the handle (10) and may have an elongated slot (1311). The elongated slot (1311) is formed through the base (131) and extends toward the front of the handle (10). The stop arm (132) may be rectangular in shape and has a first end and a second end. The first end of the stop arm (132) is mounted in the elongated slot (1311) of the base (131). The second end of the stop arm (132) extends toward the front of the handle (10) and may be a leaf spring.

The chamber (14) is formed between the first frame (11), the second frame (12) and the arresting mechanism (13).

The first casing (16) is mounted on the outer surface of the first frame (11) and has a concavity (161) and a recess (162), an arch edge (164) and a pivot hole (163). The concavity (161) is formed on the edge of the first casing (16) near the ventral portion of the handle (10) and extends toward the front of the handle (10). The recess (162) is formed in the first casing (16) at a side facing the first frame (11) near the concavity (161). The arch edge (164) of the first casing (16) corresponds to the arch edge (15) of the first frame (11). The pivot hole (163) is formed through the first casing (16) near the front of the handle (10) and corresponds to the pivot hole (112) of the first frame (11).

The second casing (17) is mounted on the outer surface of the second frame (12) and has a arch edge (172) and a pivot hole (171). The arch edge (172) of the second casing (17) corresponds to the arch edge (122) of the second frame (12). The pivot hole (171) is formed through the second casing (17) near the front of the handle (10) and corresponds to the pivot hole (121) of the second frame (12).

The blade (20) is pivotally mounted between the first frame (11) and the second frame (13). The blade (20) is selectively folded into the chamber (14) and has a rear, a spine, a notch (211) and a pivot hole (212). The rear of the blade (20) is pivotally mounted between the first frame (11) and the second frame (13). The notch (211) is formed on the spine of the blade (20) near the rear of the blade (20). The pivot hole (212) of the blade (20) is formed through the rear of the blade (20) and aligns with the pivot hole (112) in the first frame (11) and the pivot hole (121) in the second frame (12) of the handle (10).

Figure 4:
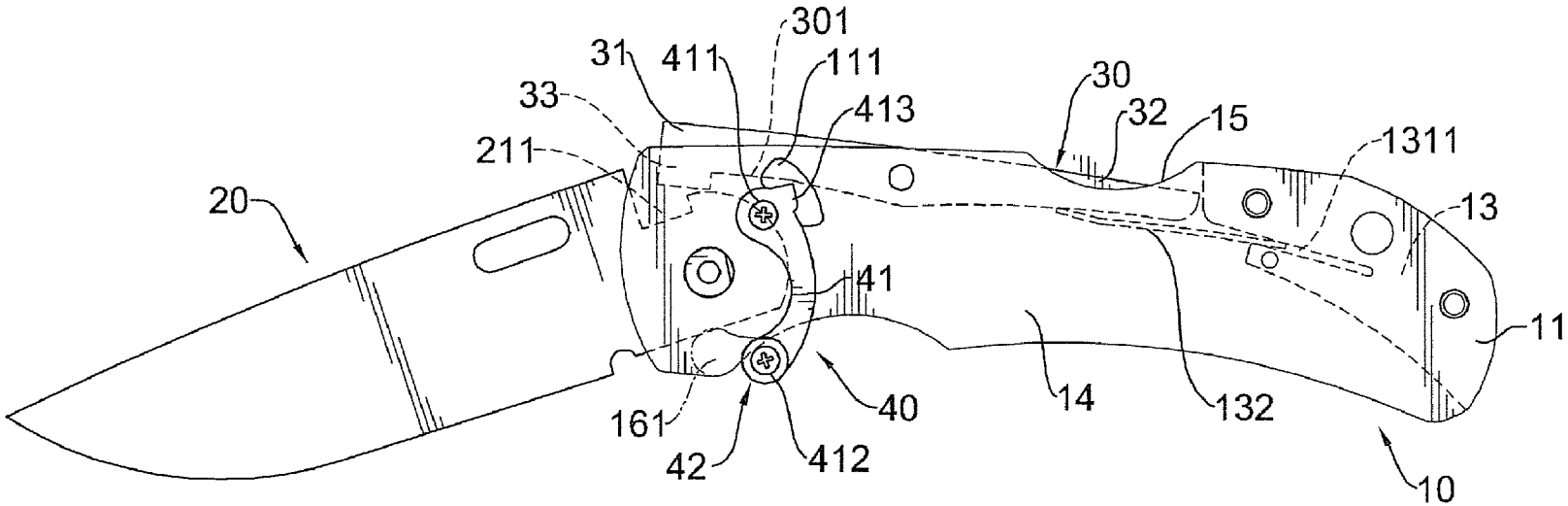
FIG. 4 is an operational side view of the folding knife in FIG. 1, showing the blade being unlocked.

With further reference to FIG. 4, the locking rod (30) is resilient. The locking rod (30) corresponds to the handle (10) and is mounted between the arresting mechanism (13) and the rear of the blade (20) and has a middle, a locking end (31), a releasing end (32), an inner edge and a protrusion (33).

The middle of the locking rod (30) is pivotally mounted between the first frame (11) and the second frame (12). The locking end (31) is mounted near the front of the handle (10) and the rear of the blade (20). The releasing end (32) is opposite to the locking end (31). The releasing end (32) is mounted between the arch edges (15, 122) of the first frame (11) and the second frame (12) and abuts the second end of the stop arm (132) of the arresting mechanism (13). The inner edge (301) of the locking rod (30) faces the chamber (14) of the handle (10). The protrusion (33) is formed on the inner edge (301) of the locking rod (30) near the locking end (31) and corresponds to and selectively engages the notch (211) of the blade (20).

Figure 5:
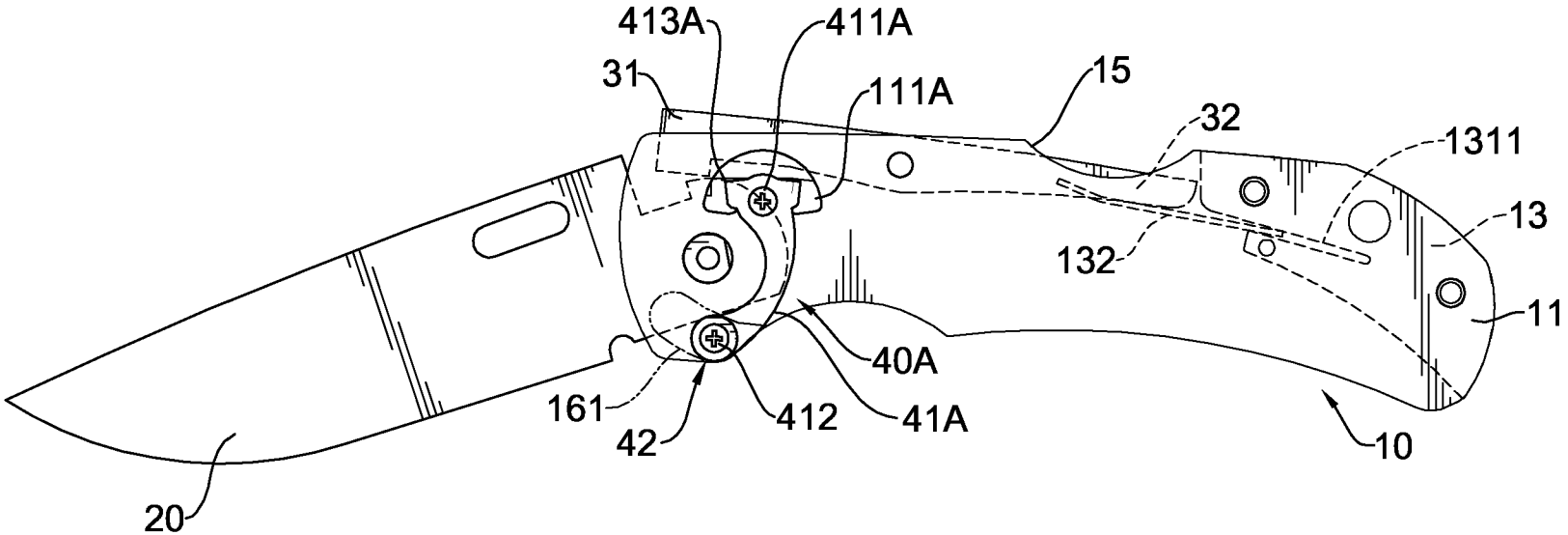
FIG. 5 is an operational side view of a second embodiment of a folding knife in accordance with the present invention.

The unlocking lever (40) is mounted to the outer surface of the first frame (11) and may be slidably disposed in the recess (162) of the first casing (16), and has a rib (41) and a knob (42). The rib (41) has a pivoting end (411), a pushing end (412) and at least one propping block (413). The pivoting end (411) is pivotally mounted on the outer surface of the first frame 911) such that the unlocking lever (40) pivots about a pivot axis (Xp), as shown in FIG. 2. The pushing end (412) extends out from the pivoting end (411) of the rib (41) toward the ventral portion of the handle (10). The propping block (413) extends through the throughhole (411). The propping block (413) extends through the throughhole (111) and abuts the inner edge (301) of the locking rod (30). With reference to FIGS. 1 and 5, two propping blocks (413A) may be respectively formed on two sides of the pivoting end (411A) of the rib (41A) across the pivot axis and extend through the throughhole (111A). The knob (42) is mounted on the pushing end (412) and abuts the concavity(l61) of the first casing (16).

The pintle (70) is mounted through the pivot holes (112, 121, 163, 171, 212) of the first frame (11), the second frame (12), the first casing (16) and the second casing (17) of the handle (10) and the blade (20).

Figure 6:
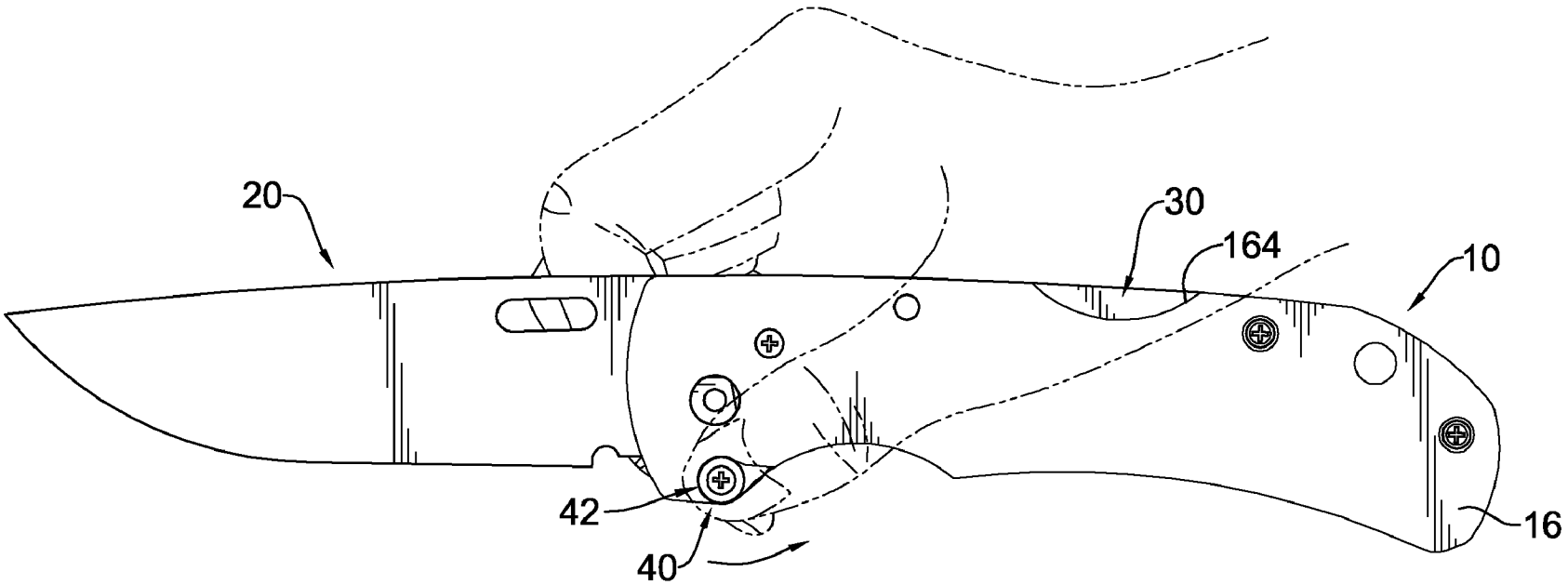
FIG. 6 is another operational side view of the folding knife in FIG. 1.
Figure 7:
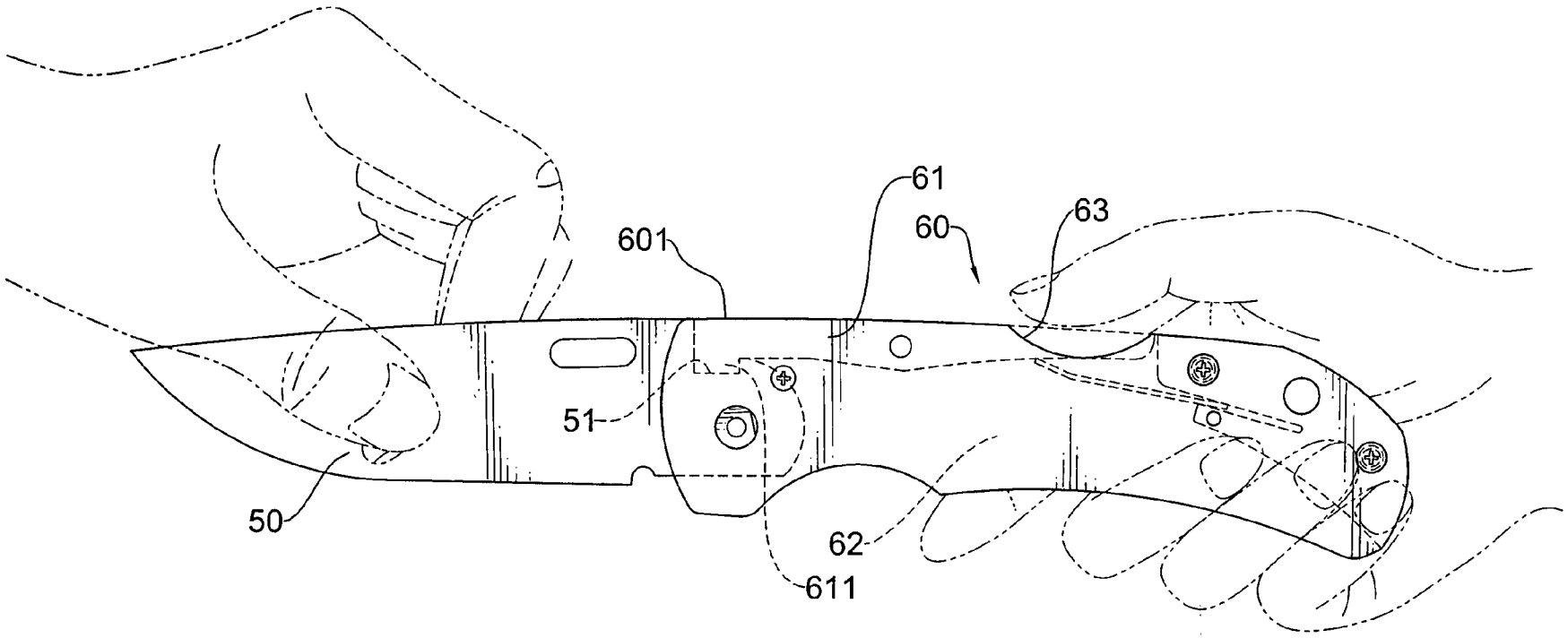
FIG. 7 PRIOR ART
FIG. 7 is an operational side view of the conventional folding knife.

With further reference to FIG. 6, when in use, a thumb is conveniently positioned on the knob (42). When the knob (42) is pushed toward the front or the rear of the handle (10), the locking end (31) of the locking rod (30) is pivoted out of the handle (10), whereby the protrusion (33) is released from the notch (211) and the blade (20) is unlocked.

The protrusion (33) of the locking rod (30) can be prodded out of the notch (211) of the blade (20) by pressing the releasing end (32) or by pushing the unlocking lever (40) toward the front or the rear of the handle (10). The blade (20) then is returned to the chamber (14) of the handle (10).

Based on the structure as described above, the folding knife in accordance with the present invention allows the blade (20) to be released either by directly pressing the releasing end (32) of the locking rod (30) or pushing the unlocking lever (40) toward the front or the rear of the handle (10). Thereby unlocking the blade (20) of the folding knife is easier and safer since a grip of the knife need not be changed. Accordingly, the folding knife in accordance with the present invention is convenient to unlock the blade (20) without changing grip on the knife by an unlocking mechanism, i.e. the unlocking lever (40).

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A folding knife with an unlocking mechanism comprising a handle having a front;

a rear;

a dorsal portion extending from the front to the rear of the handle;

a ventral portion being opposite to the dorsal portion;

a first frame having an outer surface;

a throughole being formed through the first frame near the front of the handle; and an arch edge being near being near the dorsal portion of the handle;

a second frame being attached to the first frame and having an edge;

an outer surface; and an arch edge being formed on the second frame and corresponding to the arch edge of the first frame;

an arresting mechanism being mounted between the first and the second frames near the dorsal portion of the handle;

a chamber being formed between the first frame, second frame and the arresting mechanism; and a first casing being mounted on the outer surface of the first frame and having a concavity being formed on an edge of the first casing near the ventral portion of the handle and extending toward the front of the handle; and a recess being formed in the first casing near the concavity;

a blade being pivotally mounted between the first frame and the second frame, being selectively folded into the chamber and having a rear being pivotally mounted between the first frame and the second frame;

a spine; and a notch being formed on the spine of the blade near the rear of the blade;

a locking rod being mounted between the arresting mechanism and the rear of the blade and having a middle being pivotally mounted to the first frame the second frame;

a locking end being mounted near the front of the handle;

a releasing end being opposite to the locking end, being mounted between the arch edges of the first frame and the second frame and abutting the arresting mechanism;

an inner edge facing the chamber of the handle; and a protrusion being formed on the inner edge near the locking end and corresponding to and selectively engaging the notch of the blade; and an unlocking lever being slidably disposed in the recess and mounted on the outer surface of the first frame and having a rib having a pivoting end being pivotally mounted on the outer surface of the first frame;

a pushing end extending out from the pivoting end of the rib toward the ventral portion of the handle; and two propping blocks respectively formed on and extending out from two sides of the pivoting end, extending through the throughhole and abutting the inner edge of the locking rod.

2. The folding knife as claimed in claim 1, wherein the arresting mechanism has a base being mounted between the first frame and the second frame near the rear of the handle and having an elongated slot being formed through the base and extending toward the front of the handle; and a stop arm being rectangular in shape and having a first end being mounted in the elongated slot in the base; and a second end extending toward the front of the handle.

3. The folding knife as claimed in claim 2, wherein the unlocking lever further has a knob being mounted on the pushing end and abutting the concavity of the first casing.

4. The folding knife as claimed in claim 3, wherein the handle further comprises a second casing being mounted on the outer surface of the second frame.

5. The folding knife as claimed in claim 4, wherein pivot holes are respectively formed through the first frame, the second frame, the first casing and the second casing near the front of the handle; and the blade further has a pivot hole being formed through the rear of the blade and aligning with the pivot holes of the first frame, the second frame, the first casing and the second casing of the handle; and a pintle being mounted through the pivot holes of the first frame, the second frame, the first casing and the second casing of the handle and the blade.

6. The folding knife as claimed in claim 5, wherein the first casing of the handle further has an arch edge of the first casing corresponding to the arch edge of the first frame of the handle; and the second casing of the handle further has an arch edge of the second casing corresponding to the arch edge of the second frame of the handle.

7. The folding knife as claimed in claim 6, wherein the stop arm of the arresting mechanism is a leaf spring.

* * * * *